United States Patent [19]

Schlecht

[11] Patent Number: 5,037,275

[45] Date of Patent: Aug. 6, 1991

[54] PIPE JUNCTION SWITCH FOR TWO-CYLINDER THICK-MATERIAL PUMP

[76] Inventor: Karl Schlecht, Blumhardtstrasse 9, D-7000 Stuttgart 70, Fed. Rep. of Germany

[21] Appl. No.: 481,224

[22] Filed: Feb. 20, 1990

Related U.S. Application Data

[63] Continuation-in-part of Ser. No. 210,849, Jun. 24, 1988, Pat. No. 4,893,942.

[30] Foreign Application Priority Data

Feb. 28, 1989 [DE] Fed. Rep. of Germany ..... 3905355

[51] Int. Cl.[5] ..... F04B 7/00

[52] U.S. Cl. ..... 417/517; 417/519; 417/900

[58] Field of Search ..... 417/517, 519, 900

[56] References Cited

U.S. PATENT DOCUMENTS

| | | | |
|---|---|---|---|
| 4,465,441 | 8/1984 | Schwing | 417/519 |
| 4,472,118 | 9/1984 | Schwing | 417/519 |
| 4,556,370 | 12/1985 | Schwing | 417/517 |
| 4,653,990 | 3/1987 | Schlecht | 417/900 |

*Primary Examiner*—Leonard E. Smith
*Assistant Examiner*—Alfred Basichas
*Attorney, Agent, or Firm*—Horst M. Kasper

[57] ABSTRACT

A pipe switch for two-cylinder thick-material sludge pumps comprises a pivot pipe (1) pivotable in front of a wear plate (8). A wear ring (22) is disposed axially slidable to a limited amount against the spring force of a rubber-elastic sealing ring (3) on the cylinder-side end of the pivot pipe (1). At least one stabilization ring (26', 26''), made of steel, is connected and attached to the sealing ring (3). Said stabilization ring (26', 26'') is disposed in the region of one of the two front faces of the sealing ring (3). This measure achieves a permanently sealing and wear-balancing effect even in case the sealing rings exhibit an elongated extended cross-sectional form in the axial direction.

20 Claims, 4 Drawing Sheets

PIPE JUNCTION SWITCH FOR TWO-CYLINDER THICK-MATERIAL PUMP

CROSS REFERENCE TO RELATED APPLICATIONS

This application is a continuation-in-part application of another application filed June 24, 1988, and, bearing Ser. No. 07/210,849 now U.S. Pat. No. 4,893,992. The entire disclosure of this latter application, including the drawings thereof, is hereby incorporated in this application as if fully set forth herein.

BACKGROUND OF THE INVENTION

1. Field of the invention

The present invention relates to a pipe junction switch for two-cylinder thick-material pumps with a pivot pipe pivotable in front of a cylinder-side wear plate furnished with openings, where a wear ring is disposed axially shiftable to a limited amount on the cylinder-side end of the pivot pipe.

2. Brief Description of the Background of the Invention Including Prior Art

Pipe switches of this kind which carry a wear ring, which is automatically hydrostatically adjusting and which is designated as automatic ring, are known for example the German Patent DE-PS 2,614,895 and German Patent DE-PS 3,103,321. According to the references, the wear ring and/or the pivot pipe includes annular turned grooves for receiving of the rubber-elastic sealing ring. However, in practical situations, it can be hardly avoided that the material to be transported passes and penetrates into the intermediate space between the sealing ring on the one hand and the pivot pipe or, respectively, the wear ring on the other hand. This generates the danger that the sealing ring is pushed radially inwardly and out of the intermediate space between the pivot pipe and the wear ring and thereby the sealing and wear-balancing effect of the sealing ring deteriorates. Consequently, it is frequently only possible to a limited amount to transport stiff-plastic, fine-grained material such as, for example, fine mineral pastes, as they are employed and encountered in ore mining or in the mineral oil industry, with the known pipe switch pumps. If the material to be transported changes in its compositions frequently and substantially between coarse and fine grains, as occurs for example in the clearing of rivers from mud and in the transportation of overburden in mining and tunnel construction, undesired sealing problems occur for this reason again and again in the case of the use of pipe switch pumps.

SUMMARY OF THE INVENTION

1. Purposes of the Invention

It is an object of the present invention to improve a pipe switch of the initially recited kind such that the sealing ring permanently maintains a stable position between the pivot pipe and the wear ring, independent of the kind of material to be transported.

It is another object of the present invention to provide a pipe switch with improved sealing capabilities and sealing stability.

It is yet another object of the present invention to provide a structure of a pipe switch which is adapted to a transport of coarse sludge materials.

These and other objects and advantages of the present invention will become evident from the description which follows.

2. Brief Description of the Invention

The present invention provides a pipe switch for a two-cylinder thick-material sludge pump. A pivot pipe exhibits a ring shoulder or ring shoulder protrusions and is pivotable in front of a wear plate furnished with openings. A wear ring with a ring shoulder is disposed slidable over a limited axial distance at an end of the pivot pipe. The end of the pivot pipe is disposed near the cylinder. A rubber-elastic sealing ring exhibits front faces in axial direction. The sealing ring rests with its outer face against an adjoining centering face. The sealing ring is disposed between the ring shoulder protrusions of the pivot pipe and the ring shoulder of the wear ring. The sealing ring is subjected to a hydrostatic pressure prevailing in the pivot pipe. The sealing ring is pressable with one of its front faces against the pivot pipe. At least one rigid stabilization ring is attached to the sealing ring. The axial and radial dimensions of the stabilization ring amount to a fraction of the respective dimensions of the corresponding sealing ring.

Said sealing ring can exhibit an axially elongated extended cross-section. The stabilization ring can exhibit an elongated cross-section. The stabilization ring can be made of a metal. The stabilization ring can also exhibit a rectangular cross-section and be made of steel. The adjoining centering face of the wear ring can be provided by the pivot pipe or by the wear ring.

The stabilization ring can alternatively be made of a shape-retaining plastic material or rubber. The stabilization ring can be disposed in the region of one of the two front faces of the sealing ring. A second stabilization ring can be provided, wherein the first stabilization ring can be disposed in the neighborhood of one of the two front faces of the sealing ring. The stabilization ring can be recessed relative to the neighboring front face of the sealing ring by a small spacing distance of about 0.3 to 2.0 mm. The sealing ring can form a chamfered or bevelled edge in the spacing region between the front face of the sealing ring and the stabilization ring. The stabilization ring can be recessed relative to the neighboring front face of the sealing ring by a small spacing distance of about 0.8 to 1.2 mm. The stabilization ring can be vulcanized onto the sealing ring or be embedded and vulcanized into the sealing ring material. The stabilization ring can be disposed in the region of the inner face of the sealing ring. The stabilization ring can be made of a shape-retaining plastic material or rubber. The first stabilization ring and the second stabilization ring can be furnished in the region of a cylindrical inner face of the sealing ring. Said stabilization ring can be furnished in the region of an inner face of the sealing ring. A second stabilization ring can be disposed in a region of an outer face of the sealing ring.

According to the invention, the pivot pipe comprises a wear ring and a rubber-elastic sealing ring. The sealing ring rests with its outer face against a centering face of the pivot pipe or of the wear ring. The sealing ring is further disposed .between, in each case, one ring shoulder protrusion of the pivot pipe and of the wear ring. The sealing ring is pressable with its front faces against the said shoulder protrusions of the pivot pipe and the wear ring, under the force of the hydrostatic pressure prevailing in the pivot pipe.

At least one stabilization ring, made of a rigid material, is connected with the sealing ring. The axial and radial dimensions of the stabilization ring amount to a fraction of the respective dimensions of the corresponding sealing ring. The stabilization ring is preferably made of an inherently stable and form-maintaining plastic material and exhibits advantageously an elongated, preferably rectangular cross-section and is preferably disposed in the region of one of the two front faces of the sealing ring.

According to a preferred embodiment of the invention, two stabilization rings are furnished. In each case, one of these stabilization rings is disposed in the neighborhood of one of the two front faces of the sealing ring. The stabilization ring is preferably and advantageously recessed in axial direction versus the neighboring front face of the sealing ring by a small spacing distance of about 0.3 to 2.0 mm, and preferably of about 1 mm. The sealing ring advantageously exhibits a chamfered or bevelled edge in the spacing distance region between the front edge and the stabilization ring.

According to a preferred embodiment of the invention, the stabilization ring is vulcanized and cured onto the sealing ring. The stabilization ring can also be embedded into the material of the sealing ring, and is preferably cured or vulcanized and/or sulfurized while disposed inside the sealing material. Particularly advantageous stabilization properties are obtained where the stabilization ring is disposed within the region of the inner cylindrical face of the sealing ring or if, in the case of two stabilization rings, both stabilization rings are disposed in the region of the inner face of the sealing ring. In principle, in case of employing two stabilization rings in a sealing ring, it is however also possible, to dispose one stabilization ring in the region of the inner face and one stabilization ring in the region of the outer face of the sealing ring.

Alternatively, it is possible to provide a sealing ring which includes a number of stabilization rings for formation of a composite structure exhibiting nonisotropic elastic properties, where the effective elasticity in axial direction is substantially larger than the elasticity in radial or circumferential direction.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENT

Figure 1:
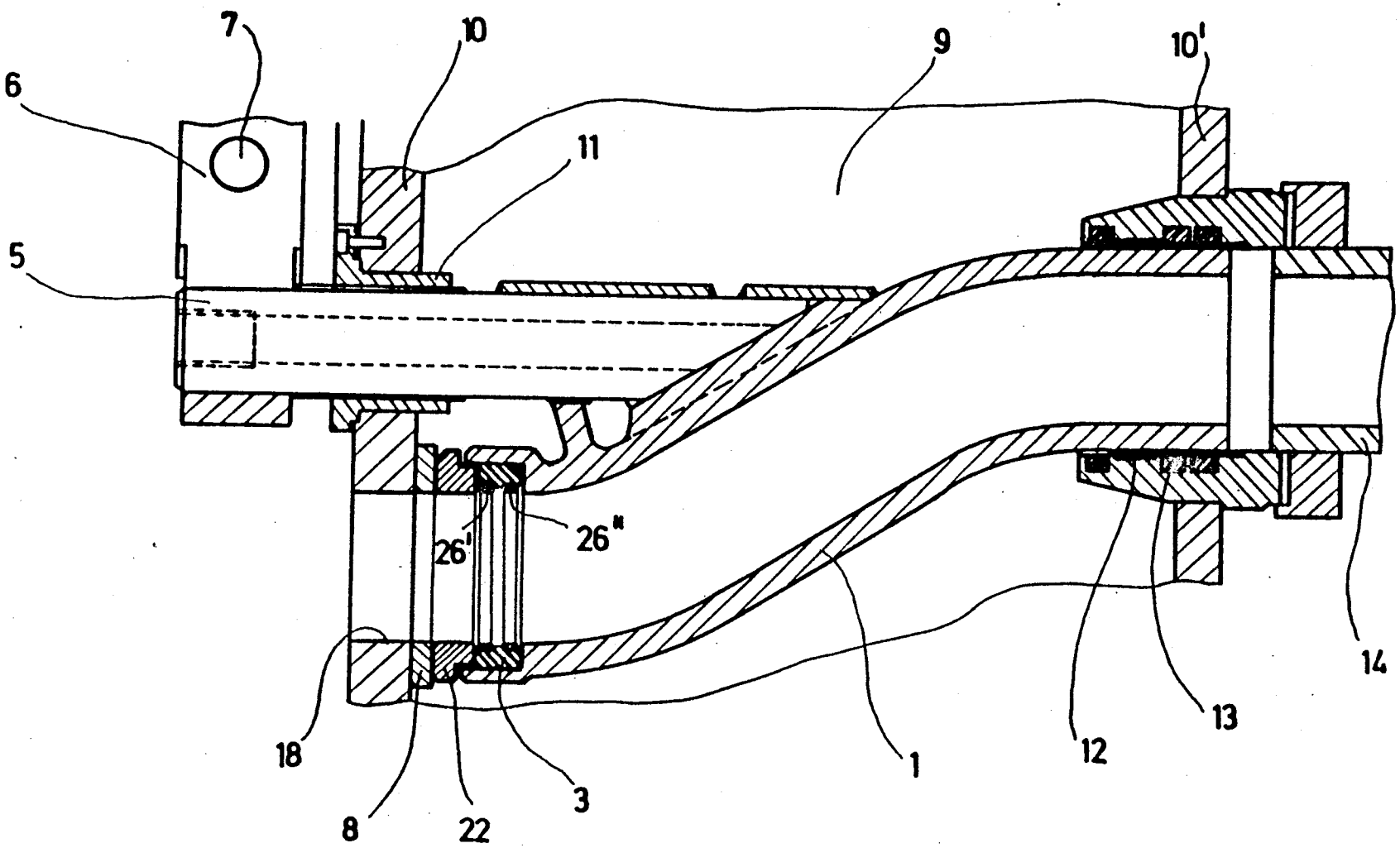
FIG. 1 is a longitudinal sectional view through a pipe switch with a S-shaped pipe.

In accordance with the present invention, there is provided a pipe switch for a two-cylinder thick-material sludge pump. A pivot pipe 1 is pivotable in front of a wear plate 8 furnished with openings 18 and disposed on the cylinder side. A wear ring 22 is disposed slidable to a limited axial amount that the cylinder-side end of pivot pipe 1.

A rubber-elastic sealing ring 3 rests with its outer face against a centering face 15 of the pivot pipe 1 or of the wear ring 22. The sealing ring 3 is disposed between ring shoulder protrusions 20, 21 of the pivot pipe 1 and of the wear ring 22. The sealing ring 3 is subjected to the hydrostatic pressure prevailing in the pivot pipe 1 and is pressable with its front faces against the pivot pipe and the wear ring. Said sealing ring 3 exhibits preferably an axially elongated extended cross-section. At least one rigid stabilization ring 26', 26'' is attached to the sealing ring 3. The axial and radial dimensions of the stabilization ring 26', 26'' amount to a fraction of the respective dimensions of the corresponding sealing ring 3.

The stabilization ring 26', 26'' can be made of a metal, preferably steel, or of a shape-retaining plastic or rubber. The stabilization ring 26', 26'' can exhibit an elongated and preferably rectangular cross-section. The stabilization ring 26', 26'' can be recessed relative to the neighboring front face of the sealing ring 3 by a small spacing distance of about 0.3 to 2.0 mm. The sealing ring 3 can form a chamfered or bevelled edge in the spacing region between the front face of the sealing ring 3 and the stabilization ring 26', 26'''. The stabilization ring 26', 26'' is preferably disposed in the region of one of the two front faces of the sealing ring 3.

Figure 4:
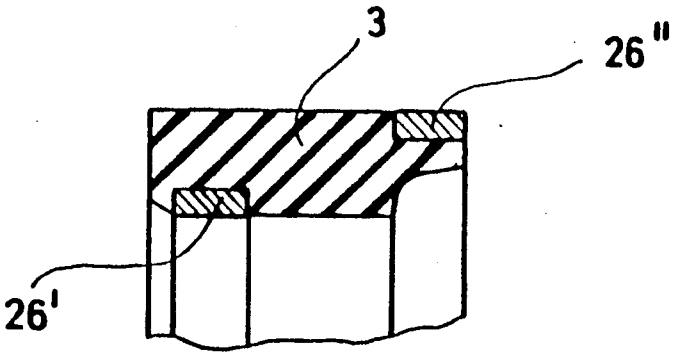
FIG. 4 is a sectional view of a second embodiment of a sealing ring incorporating two stabilization rings for the selective application in a pipe switch according to FIG. 2 or FIG. 3.

Two stabilization rings 26', 26'' can be furnished, of which one each can be disposed in the neighborhood of one of the two front faces of the sealing ring 3. One of the stabilization rings 26', 26'' can be recessed relative to the neighboring front face of the sealing ring 3 by a small spacing distance of about 1 mm. The first stabilization ring 26', 26'' can be vulcanized onto the sealing ring 3. The stabilization ring 26', 26'' can be embedded into the sealing ring material and is preferably vulcanized into the sealing ring material. The of the inner face 24 of the sealing ring 3. The first stabilization ring 26' is preferably furnished in the region of the inner face 24 and the second stabilization ring 26'' is furnished in region of the outer face 23 of the sealing ring 3 (FIG. 4). Two stabilization rings 26', 26'' can also be furnished in the region of the cylindrical inner face 24 of the sealing ring 3.

The two-cylinder thick-material sludge pump illustrated in part in a sectional view in FIG. 1 (as well as in U.S. patent application, Ser No. 07/210,849 filed June 24, 1988) is covered by an eyeglass-shaped wear plate, furnished with two openings 18 for the passage of material, at the side of the rear wall 10 of a material feed container 9 at the orifices of two transport cylinders. The pivot pipe 1 of a pipe switch is disposed at the inner side of the material feed container 9. The front face of the pivot pipe 1, carrying a wear ring 22, is pivotable back and forth in front of the wear plate 8 around a horizontal axis by way of a pivot shaft 5. This brings about that the cylinder-side opening of the pivot pipe 1 passes alternatingly in front of one of the two openings 18 of opening 18 toward the interior of the material feed container 9. A wear ring 22, with its axially protruding centering ring 2, is axially shiftably supported in the cylindrical centering face 15 of the pivot pipe 1 by way of the pressure-sealing connection of the pivot pipe 1 to the wear plate 8. The end of the pivot pipe 1, disposed opposite to the wear plate 8 is supported by means of a pressure pipe seal 13 in a pressure pipe support 12, passing through the respective wall 10' of the material feed container 9 and opens there into a transport pipe 14. Transport cylinders can be disposed to the left side of FIG. 1 in connection with the openings 18. The actuation of the pivot pipe is performed via a switch lever 6, actuatable by a hydraulic means 7. Said switch lever 6 drives the pivot shaft 5 supported in the shaft bearing 11 disposed in the container rear wall 10.

The pivot pipe and the wear ring 22 are bridged over in the intermediate space between their shoulder protrusions 20 and 21 by an elastic sealing ring 3. The elastic sealing ring 3 rests with its outer face 23 over its complete length against the centering face 15 of the pivot pipe 1. The sealing ring 3 is directed with its inner face 24 toward the interior of the pivot pipe 1 and is submitted to the pressure of the transport material 25.

Figure 2:
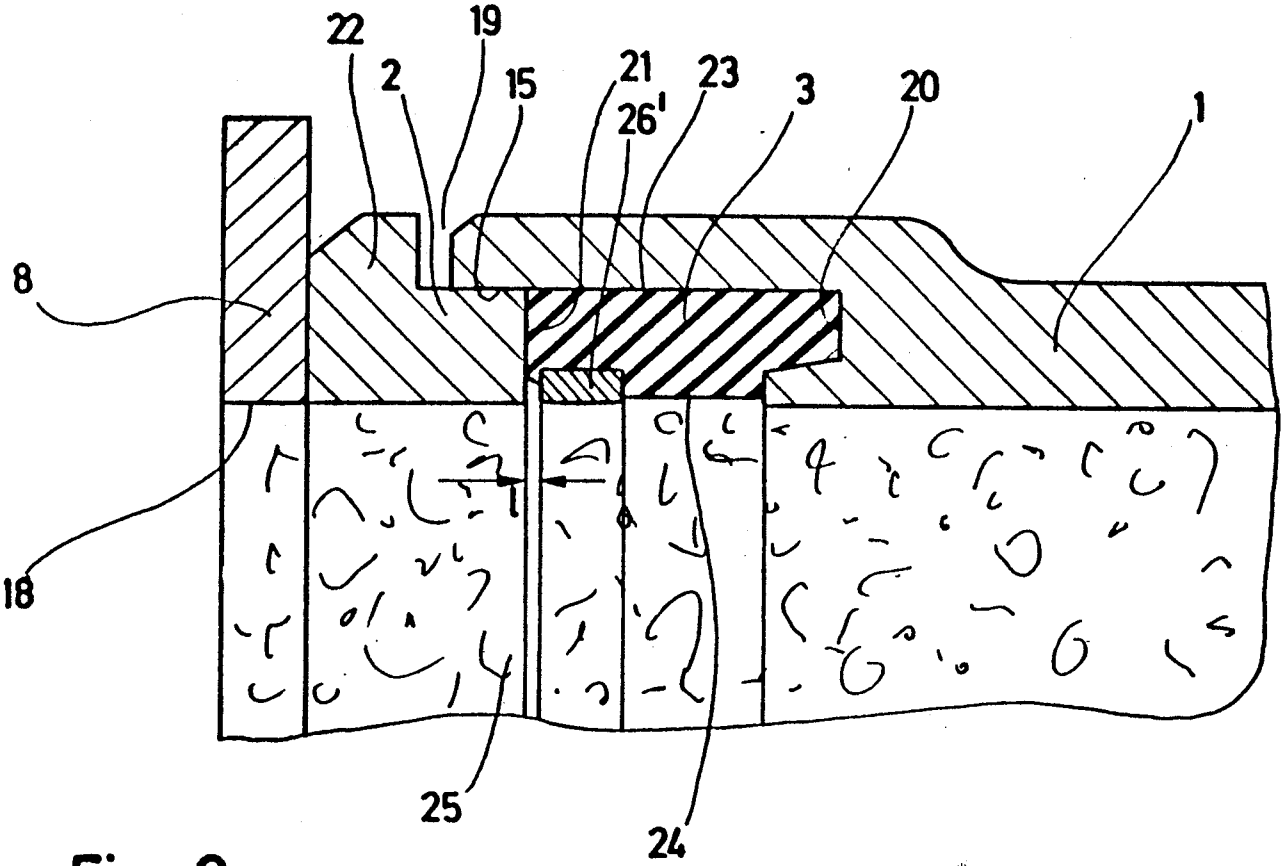
FIG. 2 is a sectional view of the embodiment of FIG. 1 with an enlarged detail of the sealing ring stabilized with one stabilization ring.
Figure 3:
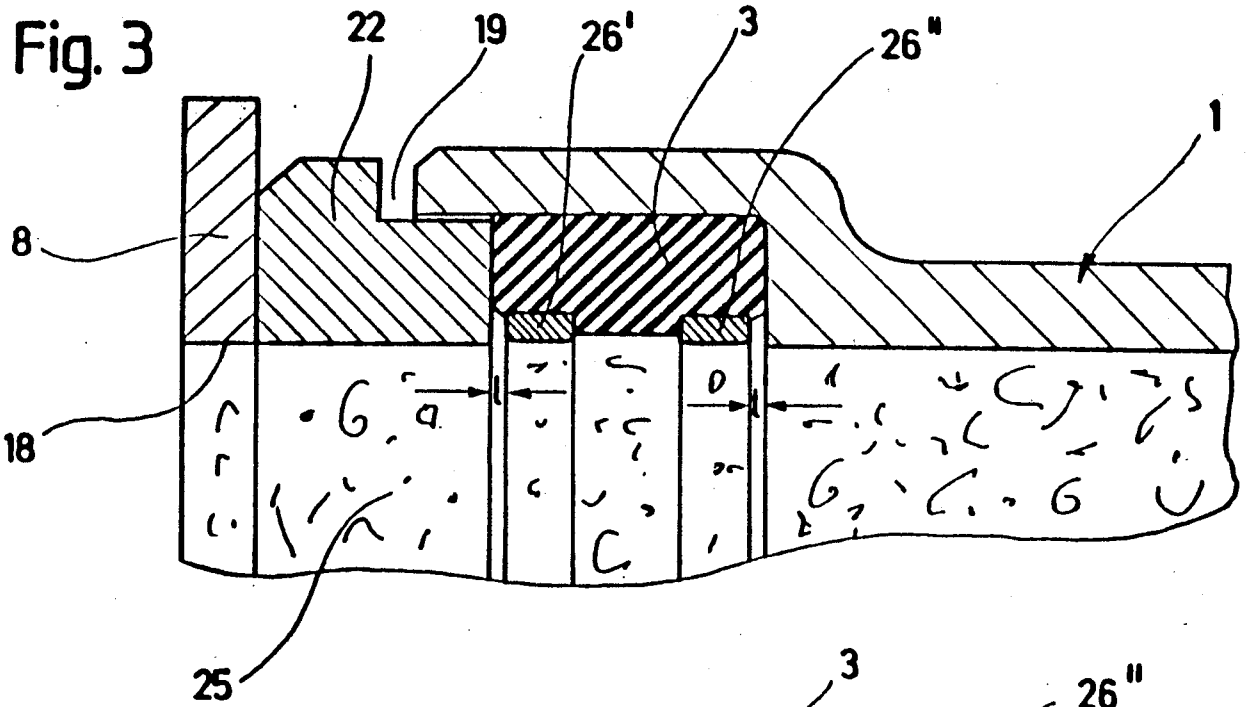
FIG. 3 is a sectional view of a first embodiment of FIG. 1 with an enlarged detail of the sealing ring stabilized with two stabilization rings.
Figure 5:
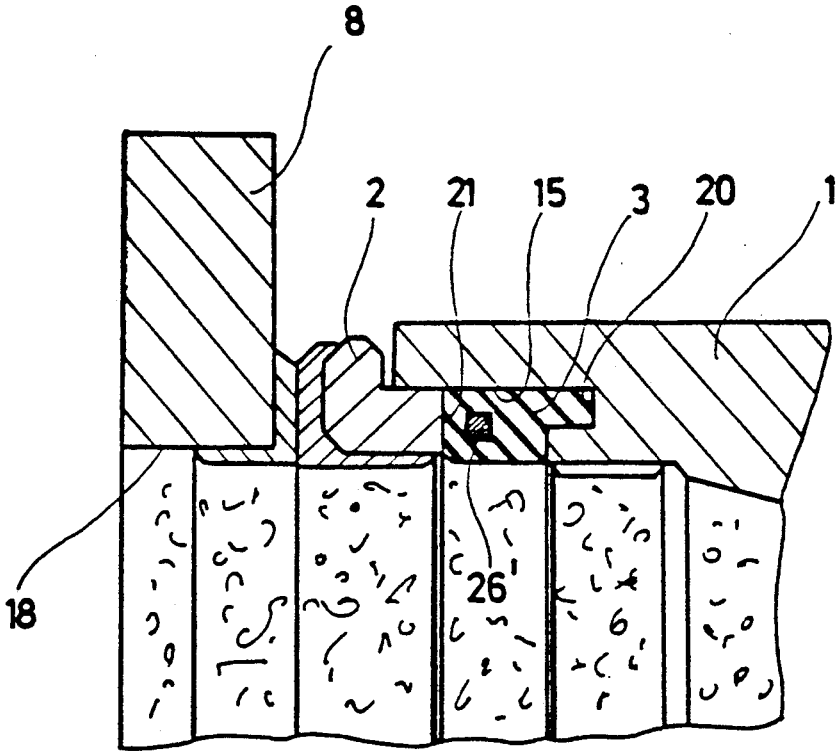
FIG. 5 is a sectional view of another embodiment with a modified sealing ring with an enlarged detail of a sealing ring incorporating a stabilization ring.

In case of the embodiments illustrated in FIGS. 2 and 5, a stabilization ring 26', and in case of the embodiments illustrated in FIGS. 3 and 4, two stabilization rings 26' and 26'' are furnished for form stabilization of the rubber-elastic sealing ring 3. The stabilizations ring are vulcanized into the elastomeric sealing material. The stabilization rings 26', 26'' are recessed relative to the neighboring shoulder protrusions 21, 20 of the wear ring 22 or, respectively, of the pivot pipe 1, by a small distance 1 of from about 0.5 to 3.0 mm such that the rubber-elastic material of the sealing ring can penetrate into the thereby furnished slot when it is compressed. The structural form illustrated in FIG. 4 of the sealing ring 3 unites in itself the properties of the sealing rings of FIGS. 2 and 3 and can consequently be employed in the two types of pipe switches, corresponding to the embodiments of FIG. 2 and FIG. 3. A slot 19 remains on the outside of the pipe switch between the pivot pipe 1 and the wear ring 22, which slot 19 limits the shifting path of the wear ring 22 on the pivot pipe 1 during a press-on process.

The embodiment illustrated in FIG. 5 corresponds substantially to the embodiment according to FIG. 2 with one difference, namely that the stabilization ring 26' exhibits a shape substantially square in cross-section and is embedded completely into the elastomeric material of the sealing ring 3. The stabilization ring 26' is disposed in the case of the two embodiments in the neighborhood of the wear-ring-side end of the sealing ring 3, whereas the second, pivot-pipe-side end of the sealing ring 3 engages into a front-side, edge-open inlaid groove of the pivot pipe 1 limited at its floor by the shoulder protrusion 20.

The stabilization ring 26', 26'' can have a longitudinal extension which corresponds from about 0.2 to 0.4, and preferably from 0.25 to 0.3 times the length of the sealing ring 3. The radial extension of the stabilization ring 26', 26'' can be from about 0.1 to 0.4, and is preferably between 0.15 and 0.25 times the radial extension of the sealing ring 3. The position of the stabilization ring 26'' is preferably at an axial distance of between 0.01 and 0.1 of the length of the sealing ring 3 from a front end of the sealing ring 3 and is preferably between 0.02 and 0.05 from a front end of the sealing ring 3. In case two stabilization rings 26', 26'' are provided, they are preferably disposed near diagonally opposed ring corners of the sealing ring 3.

In case the stabilization ring 26' is embedded into the sealing ring 3, it is preferably disposed within a center third extension of the overall radial extension of the sealing ring 3. If the stabilization ring 26' is disposed inside the sealing ring 3, it is preferably of a square or of a spherical cross-sectional shape. The sealing ring 3 is preferably provided with a shoulder protrusion which can be fitted into a matching groove of the pivot pipe 1. This shoulder protrusion is preferably disposed on a side opposite to that in which the stabilization ring 26' is placed. The overall shape of a stabilization ring can be that of a rectangle, where the longitudinal extension of the rectangle is from about 1.5 to 3.0 times the radial extension, and preferably from about 1.8 to 2.5 times the radial extension.

It will be understood that each of the elements described above, or two or more together, may also find a useful application in other types of pipe switches differing from the types described above.

While the invention has been illustrated and described as embodied in the context of a pipe junction switch for two-cylinder thick-material pump, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claim

1. A pipe switch for a two-cylinder thick-material pump comprising a pivot pipe, where the pivot pipe is pivotable in front of a wear plate disposed between one end of the pivot pipe and the pump cylinders and furnished with openings for the passage of material;

a wear ring slidably disposed at said one end of the pivot pipe with limited axial movability, and having a ring shoulder;

a rubber-elastic sealing ring disposed between a ring shoulder of the pivot pipe and the ring shoulder of the wear ring, where the sealing ring rests with its outer face against an adjoining centering face, wherein the sealing ring is subjected to a hydrostatic pressure prevailing in the pivot pipe, and wherein the sealing ring is pressable with its front faces against the ring shoulder of the pivot pipe an the ring shoulder of the wear ring;

at least one rigid stabilization ring attached to the sealing ring where the axial and radial dimensions of the stabilization ring amount to a fraction of the respective dimensions of the corresponding sealing ring; wherein the stabilization ring is recessed relative to the neighboring front face of the sealing ring by a small spacing distance; wherein the sealing ring forms a chamfered or bevelled edge in the spacing region between the front face of the sealing ring and the stabilization ring.

2. The pipe switch according to claim 1, wherein said stabilization ring is made of a metal.

3. The pipe switch according to claim 1, wherein said stabilization ring is made of a shape-retaining plastic material or rubber.

4. The pipe switch according to claim 1, wherein said stabilization ring exhibits an elongated cross-section.

5. The pipe switch according to claim 1, wherein the adjoining centering face is provided by the pivot pipe.

6. The pipe switch according to claim 1, wherein the adjoining centering face is provided by the wear ring.

7. The pipe switch according to claim 1, wherein the stabilization ring is disposed in the region of one of the two front faces of the sealing ring.

8. The pipe switch according to claim 1, further comprising a second stabilization ring; wherein the first stabilization ring is disposed in the neighborhood of one of the two front faces of the sealing ring and wherein the second stabilization ring is disposed in the neighborhood of the other of the two front faces of the sealing ring.

9. The pipe switch according to claim 1, wherein the stabilization ring is recessed relative to the neighboring front face of the sealing ring by a small spacing distance of from about 0.3 to 2.0 mm.

10. The pipe switch according to claim 1, wherein the stabilization ring is vulcanized onto the sealing ring.

11. The pipe switch according to claim 1, wherein the stabilization ring is embedded into the sealing ring material.

12. The pipe switch according to claim 1, wherein the stabilization ring is disposed in the region of an inner face of the sealing ring.

13. The pipe switch according to claim 1, further comprising a second stabilization ring; wherein the first and the second stabilization ring are disposed in the region of an inner face of the sealing ring.

14. The pipe switch according to claim 1, further comprising a second stabilization ring; wherein the first stabilization ring is disposed in the region of an inner face of the sealing ring; and wherein the second stabilization ring is disposed in the region of the outer face of the sealing ring.

15. A pipe switch of a two-cylinder thick-material sludge pump with a pivot pipe (1) pivotable in front of a wear plate (8) furnished with openings (18) and disposed on the cylinder-side end of the pivot pipe (1), with a wear ring (22) disposed slidable to a limited axial amount at the cylinder-side end of the pivot pipe (1), and with a rubber-elastic sealing ring (3), where the sealing ring rests with its outer face against a centering face (15) of the pivot pipe (1) and of the wear ring (22), and where the sealing ring (3) is disposed between ring shoulder protrusions (20, 21) of the pivot pipe (1) and of the wear ring (22), and wherein the sealing ring (3) is subjected to the hydrostatic pressure prevailing in the pivot pipe (1) and is pressable with its front faces against the pivot pipe and the wear ring, said sealing ring (3) exhibiting preferably an axially elongated extended cross-section, wherein at least one rigid stabilization ring (26', 26'') is attached to the sealing ring (3), where the axial and radial dimensions of the stabilization ring (26', 26'') amount to a fraction of the respective dimensions of the corresponding sealing ring (3);

wherein the stabilization ring (26', 26'') is recessed relative to the neighboring front face of the sealing ring (3) by a small spacing distance;

wherein the sealing ring (3) forms a chamfered or bevelled edge in the spacing region between the front face of the sealing ring (3) and the stabilization ring (26', 26'').

16. The pipe switch according to claim 15, wherein the stabilization ring (26', 26'') is made of a metal, preferably steel, or of a shape-retaining plastic or rubber; wherein the stabilization ring (26', 26'') exhibits an elongated and rectangular cross-section;

wherein the stabilization ring (26', 26''is recessed relative to the neighboring front face of the sealing ring (3) by a small spacing distance of from about 0.3 to 2.0 mm; wherein the sealing ring (3) forms a chamfered or bevelled edge in the spacing region between the front face, of the sealing ring (3) and the stabilization ring (26', 26''); and wherein the stabilization ring (26', 26'') is disposed in the region of one of the two front faces of the sealing ring (3).

17. The pipe switch according to claim 15, wherein two stabilization rings (26', 26'') are furnished, of which one each is disposed in the neighborhood of one of the two front faces of the sealing ring (3);

wherein one of the stabilization rings (26', 26') is recessed relative to the neighboring front face of the sealing ring (3) by a small spacing distance of about 1 mm; and wherein the first stabilization ring (26', 26'') is vulcanized onto the sealing ring (3).

18. The pipe switch according to claim 16, wherein the stabilization ring (26', 26'') is embedded into the sealing ring material and is vulcanized into the sealing ring material;

wherein the stabilization ring (26', 26'') is disposed in the region of the inner face (24) of the sealing ring (3).

19. The pipe switch according to claim 15, wherein the first stabilization ring (26') is furnished in the region of the inner face (24) and the second stabilization ring (26'') is furnished in region of the outer face (23) of the sealing ring (3). (FIG. 4).

20. The pipe switch according to claim 15, wherein two stabilization rings (26', 26'') are furnished in the region of the cylindrical inner face (24) of the sealing ring (3).

* * * * *

UNITED STATES PATENT AND TRADEMARK OFFICE

CERTIFICATE OF CORRECTION

PATENT NO. : 5,037,275

DATED : 08/06/1991

INVENTOR(S) : Karl Schlecht

It is certified that error appears in the above-identified patent and that said Letters Patent is hereby corrected as shown below:

Please insert in the patent as follows:

Title page, under [30]

June 27, 1987 [DE] Fed. Rep. of Germany 3721248.

Signed and Sealed this

Twenty-seventh Day of April, 1993

*Attest:*

MICHAEL K. KIRK

*Attesting Officer*

*Acting Commissioner of Patents and Trademarks*